US005575222A

United States Patent [19]

Sauer et al.

[11] Patent Number: 5,575,222

[45] Date of Patent: Nov. 19, 1996

[54] TELESCOPING BRIDGE PLATE FOR AUTORACK RAILROAD CARS

[75] Inventors: Robert J. Sauer, Blackwood, N.J.; Charles L. Van Auken, Dillsburg; John W. Rudibaugh, West Chester, both of Pa.

[73] Assignee: Pennsy Corporation, West Chester, Pa.

[21] Appl. No.: 513,133

[22] Filed: Aug. 9, 1995

[51] Int. Cl.[6] ..... B61D 49/00; B61D 3/00

[52] U.S. Cl. ..... 105/458; 105/355; 414/340; 296/61

[58] Field of Search ..... 105/355, 458, 105/459; 414/340, 343; 296/57.1, 61

[56] References Cited

U.S. PATENT DOCUMENTS

| | | | |
|---|---|---|---|
| 84,808 | 12/1868 | Elder | 105/458 |
| 2,205,823 | 6/1940 | Rice | 296/57.1 |
| 2,783,080 | 2/1957 | Ringsby | 296/61 X |
| 4,721,426 | 1/1988 | Bell et al. | 105/458 X |

FOREIGN PATENT DOCUMENTS

| | | | |
|---|---|---|---|
| 345497 | 12/1989 | European Pat. Off. | 105/458 |
| 12846 | 5/1902 | United Kingdom | 105/458 |

*Primary Examiner*—Robert J. Oberleitner
*Assistant Examiner*—Kevin D. Rutherford
*Attorney, Agent, or Firm*—John F. A. Earley; John F. A. Earley, III

[57] ABSTRACT

A telescoping bridge plate for auto rack railroad cars for supporting automobiles being driven between railroad cars comprises a top plate with corrugations providing top surfaces separated by grooves, with the top plate having an overlapping end portion and a locking end portion, a bottom plate with corrugations providing top surfaces which seat beneath the top surfaces of the top plate, and grooves which seat beneath the grooves of the top plate, with the bottom plate having an overlapping end portion and a locking end portion, and with the top plate overlapping end portion and the bottom plate overlapping end portion being in sliding overlapping engagement. A cross bar holds the top and bottom plates together and prevents them from separating vertically, and a bridge plate connector is mounted on the locking ends of the top and bottom plates to connect the bridge plates to adjacent auto rack railroad cars so that the bridge plate extends between the adjacent auto rack railroad cars and motor vehicles may be driven from one railroad car to another over the bridge plate to load or unload the autorack railroad cars.

8 Claims, 2 Drawing Sheets

TELESCOPING BRIDGE PLATE FOR AUTORACK RAILROAD CARS

BACKGROUND OF THE INVENTION

1. Field of the Invention

This invention relates to autorack railroad cars for transporting automobiles and other motor vehicles from the manufacturer to designated delivery points, and is more particularly concerned with bridge plates between autorack railroad cars that permit the automobiles to be driven from one railroad car to another when the autorack railroad cars are being loaded with automobiles or when the automobiles are being discharged from the autorack railroad car train. More particularly, this invention is concerned with portable telescoping bridge plates which are adjustable and extend between autorack railroad cars even though such cars are not always the same distance apart.

2. Description of the Prior Art

Autorack railroad cars are formed into a train with the railroad cars connected together, and bridge plates are connected between the cars in order to load the automobiles, vans, and other motor vehicles into the autorack railroad train and pass the autos through the cars from one car to another to fill the train, and to empty the train when the autos are being delivered to their destination.

Because of differences in coupler cushioning movement of various autorack railroad cars, they may not be the same distance apart when connected together in a train, and this may cause problems with bridge plates that may be too short to be mounted between the railroad cars, or may be too long so that a bridge plate may be connected to one railroad car while it may not be connected to the other railroad car and would have its unconnected end resting on the other railroad car and extending into the air so as to cause a bump when an automobile was driven over it which might throw the automobile up and scrape the roof of the automobile on the above railroad car deck.

SUMMARY OF THE INVENTION

It is an object of the present invention to provide a bridge plate which is portable and may be adjusted in length so as to be connected at one end to one autorack railroad car and be connected at the other end to the immediately adjacent autorack railroad car.

This is accomplished by making the bridge plate of this invention telescoping so that it may be adjusted to fit the distance between the two autorack railroad cars.

It is another object of this invention to provide a telescoping bridge plate which is light in weight and easily carried by the men who connect the bridge plate to the railroad cars, and yet is strong enough to support the weight of motor vehicles such as automobiles, trucks, and vans that are being driven over it in an autorack railroad car train.

It is another object of this invention to provide a telescoping bridge plate with a top and bottom plate which are in sliding engagement with each other and which easily adjust to the distance between the autorack railroad cars.

It is another object of this invention to provide a telescoping bridge plate with top and bottom plates that are prevented from separating from each other vertically.

It is another object of this invention to provide top and bottom telescoping plates which are prevented from sliding apart.

It is another object to provide a catch assembly for holding the top and bottom plates in extended position and for holding the top and bottom plates in retracted position.

It is another object of this invention to provide a bridge plate with a connecting assembly for mounting the bridge plate onto the ends of adjacent autorack railroad cars.

DETAILED DESCRIPTION OF THE DRAWING

Figure 1:
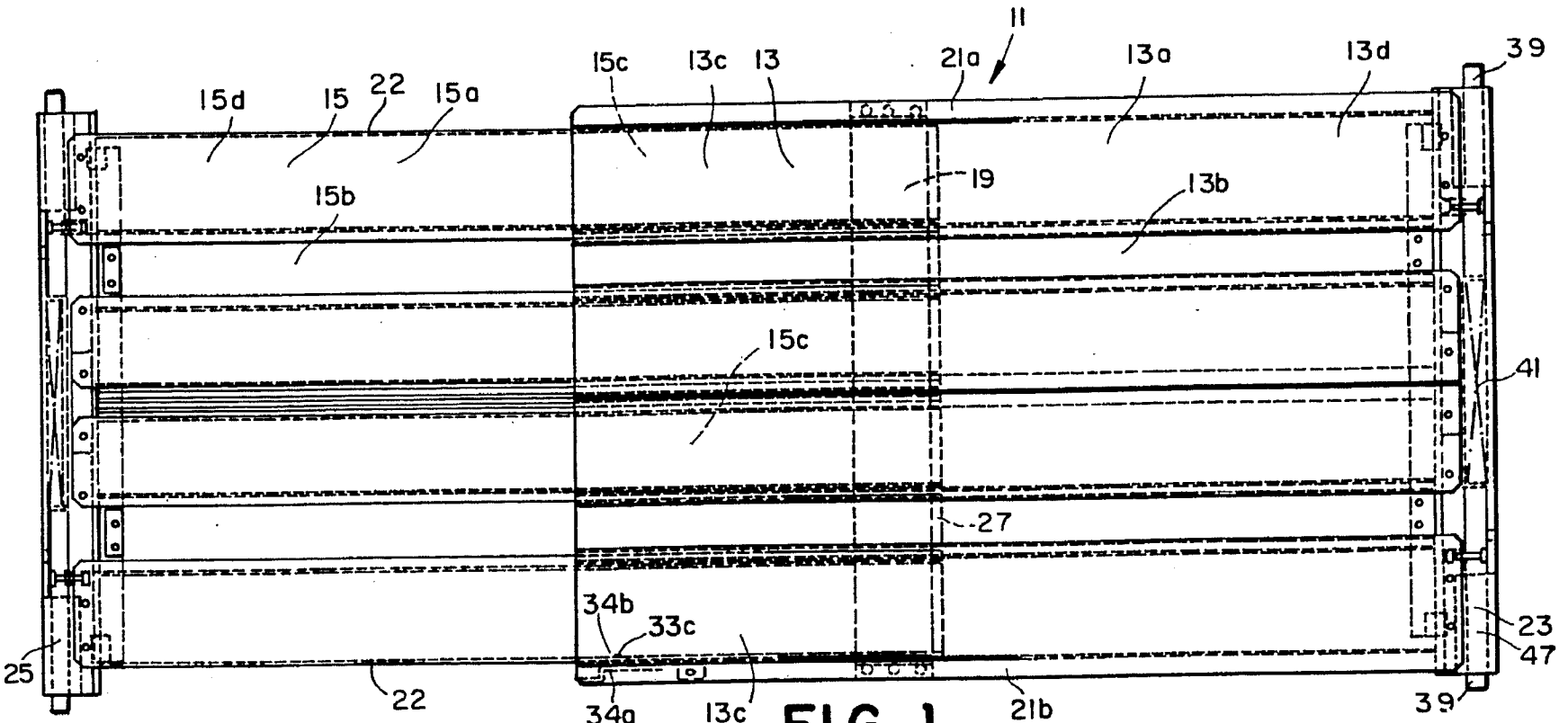
FIG. 1 is a view in top plan of a telescoping bridge plate for autorack railroad cars constructed in accordance with this invention.
Figure 3:
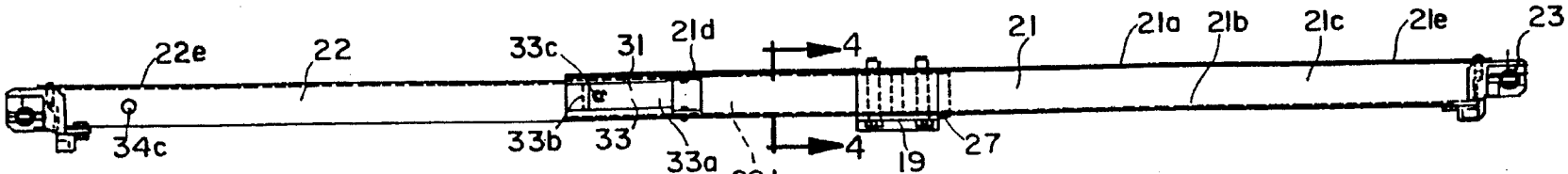
FIG. 3 is a side elevation view of the bridge plate of FIG. 1 looking from the side of the bridge plate of FIG. 1.
Figure 2:
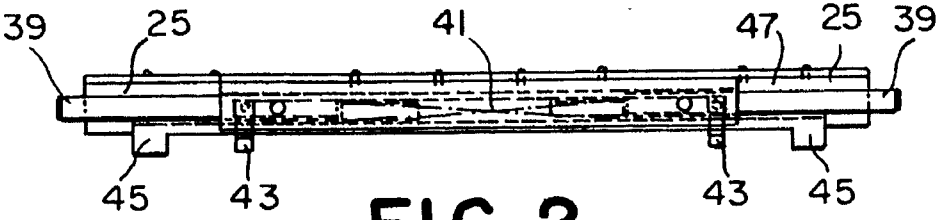
FIG. 2 is an end view of the bridge plate of FIG. 1 looking from the left end of FIG. 1.
Figure 4:
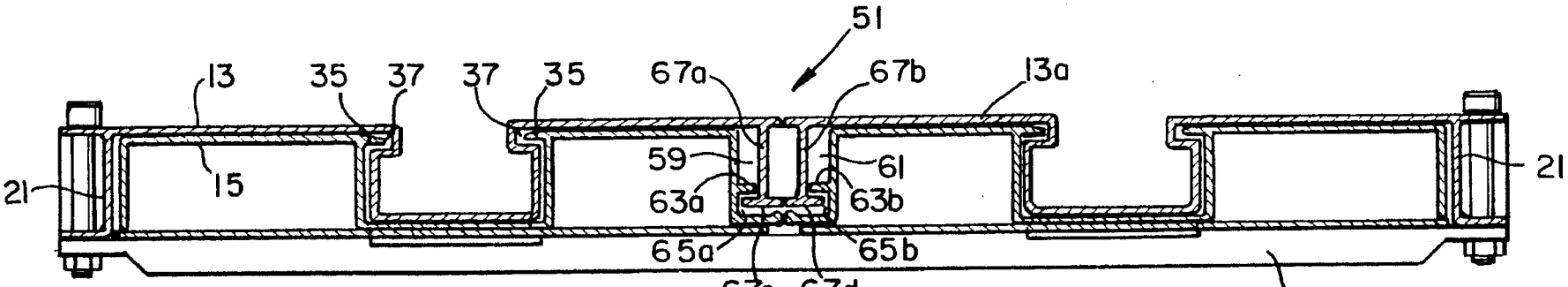
FIG. 4 is an enlarged view in cross-section taken as indicated by the lines and arrows 4—4 which appear in FIG. 3.

Turning now to the drawings, a telescoping bridge plate 11 for autorack railroad cars is shown which comprises a top plate 13 with corrugations providing top surfaces 13*a* separated by grooves 13*b*. The top plate 13 has an overlapping end portion 13*c* and a locking end portion 13*d*.

Telescoping bridge plate 11 is also provided with a bottom plate 15 with corrugations with top surfaces 15*a* which seat beneath the top surfaces 13*a* of the top plate 13, and grooves 15*b* which seat beneath the grooves 13*b* of the top plate 13. Bottom plate 15 also has an overlapping end portion 15c and a locking end portion 15*d*. The overlapping end portion 13*c* of top plate 13 is in sliding engagement with the overlapping end portion 15*c* of the bottom plate 15. Thin sheets or sliding layers 17 of plastic are provided between the sliding surfaces of top plate 13 and bottom plate 15 to make the top plate 13 and bottom plate 15 slide more easily.

A cross bar 19 is mounted on side walls 21, of the top plate 13 and extends under the bottom plate 15 for holding the top and bottom plates 13, 15 together and preventing them from separating vertically.

A bridge plate connector assembly 23 is mounted on the locking end portion 13*d* of top plate 13, and a bridge plate connector assembly 25 is mounted on locking end portion 15*d* of bottom plate 15.

Top plate connector assembly 23 and bottom plate connector assembly 25 connect the bridge plate 11 to adjacent autorack railroad cars so that the bridge plate 11 is mounted on both of the adjacent autorack railroad cars, and motor vehicles may be driven from one railroad car to another over the bridge plates 11.

Stops 27 are mounted on the ends of bottom plate 15 on the bottom of grooves 15*b* at the end of overlapping end portion 15*c*. These stops 27 come into abutment with cross bar 19 if someone tries to pull the top and bottom plates 13, 15 apart, and keep the plates 13 and 15 together.

The top plate side walls 21 have outwardly extending horizontal flanges 21*a*, 2*b* connected together by web 22*c*. Bottom plate 15 has side walls 22 in sliding engagement with web 22*c*.

The top plate side wall 21 has an overlapping end portion 21*d* and a locking end portion 21*e*, and side wall 22 of bottom plate 15 also has an overlapping end portion 22*d* and a locking end portion 22*e*.

A catch assembly 31 is provided for locking the top plate 13 to bottom plate 15 at an extended position of the bridge plate 11 shown in FIG. 1, and at a retracted position of the bridge plate 11.

Catch tongue 33 of catch assembly 31 has a base portion 33*a* anchored to the horizontal flanges 21*a*, 21*b* of top plate side wall 21. A resilient tongue 33*b* extends from base portion 33*a*, and resilient tongue 33 has a detent button 33*c* mounted near its free end which is insertable through matching openings 34*a* in side wall 21 and 34*b* in side wall 22, at the extended position shown in FIG. 1. At the retracted position of the bridge plate 11, the button 33*c* is inserted though opening 34*a* in side wall 21 and through opening 34*c* in side wall 22.

Another assembly for holding the top and bottom plates 13, 15 together includes ridges 35 extending from the top surface of the bottom plate 15 into slots 37 formed in the top surface of the top plate 13.

Connector assemblies 23, 25 include a pair of spring loaded locking pins mounted on the locking ends 13*d*, 15*d* of the top and bottom plates 13, 15 for fitting into pieces of pipe mounted on the ends of the railroad cars. A return spring 41 is mounted between the pair of locking pins 39, and operating handles 43 are mounted on the pair of locking pins 39 for moving the pair of locking pins 39 from extended to retracted positions. Landing feet 45 are mounted on the connector assemblies 23, 25 for protecting the operating handles 43 from contacting the ground and being broken. A lock body 47 houses the locking pins 39 and the return spring 41.

Another assembly 51 which prevents the top and bottom plates 13, 15 from separating vertically is a central grooves 59, 61 in bottom plate 15 which has two facing flanges 63*a* and 63*b* extending from the central grooves 59, 61 in the bottom plate 15 to form slots 65*a* and 65*b*.

T-shaped members are welded together to from a box shape member. Two inverted-T shaped members 67*a*, 67*b* extend downwardly from the top surface 13*a* of top plate 13 and have cross bars 67*c*, 67*d* which slide under the facing flanges 63*a*, 63*b* in slots 65*a*, 65*b* to prevent the top and bottom plates 13, 15 from separating vertically.

Catch assembly 31 is a two position catch which holds the telescoping bridge plate 11 in the full open position of FIG. 1 or in full retracted position with detent button 33*c* in opening 34*a* in sidewall 21 and opening 34*c* in sidewall 22. The detent button 33*c* slips into the holes in the side walls 21, 22 of the top plate 13 and the bottom plate 15 when those holes are in register.

Transverse stop bars 27 on the end of the bottom plate grooves 15*b* prevent the plates 13,15 from sliding apart even if the catch assembly 31 should fail.

The top and bottom plates 13, 15 are held together vertically by the cross bar 19 and by the ridges 35 and slots 37 formed in the corrugations of the top and bottom plates 13, 15, and also by flanges 63*a*, 63*b* and slots 65*a*, 65*b*.

In operation, the method of using the telescoping bridge plate 11 of this invention and of connecting adjacent autorack railroad cars together so that motor vehicles may be driven between them, comprises the steps of providing a telescoping bridge plate 11 including a top plate 13 with corrugations providing top surfaces 13*a* separated by grooves 13*b*, the top plate 13 having an overlapping portion 13*c* and a locking end portion 13*d*, a bottom plate 15 with corrugations providing top surfaces 15*a* which seat beneath the top surfaces 13*a* of the top plate and grooves 15*b* which seat beneath the grooves 13*b* of the top plate 13, with the bottom plate 15 having an overlapping end portion 15*c* and a locking end portion 15*d* with the top plate overlapping end portion 13*c* and the bottom plate overlapping end portion 15*c* being in sliding engagement with each other, means for holding top and bottom plates together and preventing them from separating vertically, and a bridge plate connecting assembly mounted on the locking ends of the top and bottom plates for connecting the bridge plates to adjacent autorack railroad cars so that the bridge plate extends between the adjacent autorack railroad cars and motor vehicles may be driven from one railroad car to another over the bridge plate, with the bridge plate connector assembly including spring loaded locking pins mounted on the locking ends of the plates for fitting into pipes mounted on the ends of the railroad cars, said locking pins being connected together by a return spring which urges the pins outwardly to a lock position, operating handles mounted on the locking pins for moving the locking pins from lock to retracted position, landing feet mounted on the bridge plate connecting means for protecting the operating handles from breakage, and a lock body which houses the locking pins and return spring, grasping the operating handles and retracting the locking pins of one of the top and bottom plates, placing the locking pins in alignment with pipes mounted on an autorack railroad car, inserting the pins into pipes mounted on an autorack railroad car, extending the top and bottom plates to an adjacent autorack railroad car, grasping the operating handles and retracting the locking pins of the other of the top and bottom plates, placing the locking pins in alignment with pipes mounted on the adjacent autorack railroad car, and inserting the pins in the pipes mounted on the other autorack railroad car.

We claim:

1. A telescoping bridge plate for auto rack railroad cars employed as a ramp for supporting motor vehicles passing from one railroad car to another railroad car in a train to bridge the space between the cars, to load or unload the railroad cars, comprising a top plate with corrugations providing top bearing surfaces separated by grooves, said top plate having an overlapping end portion and a locking end portion, a bottom plate with corrugations providing top bearing surfaces which seat beneath the top surfaces of the top plate, and grooves which seat beneath the grooves of the top plate, said bottom plate having an overlapping end portion and locking end portion, said top plate overlapping end portion and said bottom plate overlapping end portion being in sliding overlapping engagement, means for holding top and bottom plates together and preventing them from separating vertically, and bridge plate connecting means mounted on the locking ends of the top and bottom plates for connecting the bridge plates to adjacent auto rack railroad cars so that the bridge plate extends between the adjacent auto rack railroad cars and motor vehicles may be driven from one railroad car to another over the bridge plate, and stop means mounted on at least one of the plates for preventing the plates from sliding apart.

2. The telescoping bridge plate for auto rack railroad cars of claim 1, including said means for holding the top and bottom plates together including a crossbar connected between the side walls of the top plate and extending under the bottom plate.

3. A telescoping bridge plate for auto rack railroad cars to enable motor vehicles to be driven from one railroad car to another railroad car in a train, to load or unload the railroad cars, comprising a top plate with corrugations providing top surfaces separated by grooves, said top plate having an overlapping end portion and a locking end portion, a bottom plate with corrugations providing top surfaces which seat beneath the top surfaces of the top plate, and grooves which seat beneath the grooves of the top plate, said bottom plate having an overlapping end portion and locking end portion, said top plate overlapping end portion and said bottom plate overlapping end portion being in sliding overlapping engagement, means for holding top and bottom plates together and preventing them from separating vertically, and bridge plate connecting means mounted on the locking ends of the top and bottom plates for connecting the bridge plates to adjacent auto rack railroad cars so that the bridge plate extends between the adjacent auto rack railroad cars and motor vehicles may be driven from one railroad car to another over the bridge plate, said top plate having side walls with outwardly extending horizontal flanges connected together by a vertical web, said top plate side walls having an overlapping end portion and a locking end portion, said bottom plate having bottom plate side walls, and catch means with a catch tongue for locking the top plate to the bottom plate at an extended position of the bridge plate and at a retracted position of the bridge plate, said catch tongue having a base portion anchored between the outwardly extending horizontal flanges of the top plate side wall and a resilient tongue portion extending toward the overlapping end portion of the top plate side wall, said catch means including a detent button mounted on the catch tongue which is insertable through matching openings in the side walls of the top and bottom plates at the extended position and at the retracted position of the bridge plate.

4. A telescoping bridge plate for auto rack railroad cars to enable motor vehicles to be driven from one railroad car to another railroad car in a train, to load or unload the railroad cars, comprising a top plate with corrugations providing top surfaces separated by grooves, said top plate having an overlapping end portion and a locking end portion, a bottom plate with Corrugations providing top surfaces which seat beneath the top surfaces of the top plate, and grooves which seat beneath the grooves of the top plate, said bottom plate having an overlapping end portion and locking end portion, said top plate overlapping end portion and said bottom plate overlapping end portion being in sliding overlapping engagement, means for holding top and bottom plates together and preventing them from separating vertically, and bridge plate connecting means mounted on the locking ends of the top and bottom plates for connecting the bridge plates to adjacent auto rack railroad cars so that the bridge plate extends between the adjacent auto rack railroad cars and motor vehicles may be driven from one railroad car to another over the bridge plate, said means for holding the top and bottom plates together including ridges extending from the top surfaces of the bottom plate into slots formed in the top surfaces of the top plate.

5. A telescoping bridge plate for auto rack railroad cars to enable motor vehicles to be driven from one railroad car to another railroad car in a train, to load or unload the railroad cars, comprising a top plate with corrugations providing top surfaces separated by grooves, said top plate having an overlapping end portion and a locking end portion, a bottom plate with corrugations providing top surfaces which seat beneath the top surfaces of the top plate, and grooves which seat beneath the grooves of the top plate, said bottom plate having an overlapping end portion and locking end portion, said top plate overlapping end portion and said bottom plate overlapping end portion being in sliding overlapping engagement, means for holding top and bottom plates together and preventing them from separating vertically, and bridge plate connecting means mounted on the locking ends of the top and bottom plates for connecting the bridge plates to adjacent auto rack railroad cars so that the bridge plate extends between the adjacent auto rack railroad cars and motor vehicles may be driven from one railroad car to another over the bridge plate, said bridge plate connecting means including a pair of spring loaded locking pins mounted on the locking ends of the plates for fitting into pieces of pipe mounted on the ends of the railroad cars, a return spring mounted between the locking pins, operating handles mounted on the locking pins for moving the locking pins from extended to retracted position, landing feet mounted on the bridge plate connecting means for protecting the operating handles from breakage, and a lock body which houses the locking pins and return spring.

6. A telescoping bridge plate for auto rack railroad cars to enable motor vehicles to be driven from one railroad car to another railroad car in a train, to load or unload the railroad cars, comprising a top plate with corrugations providing top surfaces separated by grooves, said top plate having an overlapping end portion and a locking end portion, a bottom plate with corrugations providing top surfaces which seat beneath the top surfaces of the top plate, and grooves which seat beneath the grooves of the top plate, said bottom plate having an overlapping end portion and locking end portion, said top plate overlapping end portion and said bottom plate overlapping end portion being in sliding overlapping engagement, means for holding top and bottom plates together and preventing them from separating vertically, and bridge plate connecting means mounted on the locking ends of the top and bottom plates for connecting the bridge plates to adjacent auto rack railroad cars so that the bridge plate extends between the adjacent auto rack railroad cars and motor vehicles may be driven from one railroad car to another over the bridge plate, stop means mounted on at least one of the plates for preventing the plates from sliding apart, said top plate having side walls with outwardly extending horizontal flanges connected together by a vertical web, said top plate side walls having an overlapping end portion and a locking end portion, said bottom plate having bottom plate side walls, and catch means with a catch tongue for locking the top plate to the bottom plate at an extended position of the bridge plate and at a retracted position of the bridge plate, said catch tongue having a base portion anchored between the outwardly extending horizontal flanges of the top plate side wall and a resilient tongue portion extending toward the overlapping end portion of the top plate side wall, said catch means including a detent button mounted on the catch tongue which is insertable through matching openings in the side walls of the top and bottom plates at the extended position and at the retracted position of the bridge plate, said means for holding the top and bottom plates together including a cross bar connected between the side walls of the top plate and extending under the bottom plate, said means for holding the top and bottom plates together including ridges extending from the top surfaces of the bottom plate into slots formed in the top surfaces of the top plate, said bridge plate connecting means including a pair of spring loaded locking pins mounted on the locking ends of the plates for fitting into pieces of pipe mounted on the ends of the railroad cars, a return spring mounted between the locking pins, operating handles mounted on the locking pins for moving the locking pins from extended to retracted position, landing feet mounted on the bridge plate connecting means for protecting the operating handles from breakage, and a lock body which houses the locking pins and return spring.

7. A telescoping bridge plate for auto rack railroad cars, comprising a top plate with corrugations providing 3 top surfaces separated by 2 grooves with oppositely facing side rails at each side of the top plate, a bottom plate with 4 top surfaces separated by 2 side grooves and a central groove, a central groove with flanges extending inwardly from the central groove in the bottom plate to provide strength and a connection slot, a pair of inverted T members extending downwardly from the top plate forming a box-shaped member and having outwardly extending flanges which slide in the connection slots, each of the 2 bottom plate side grooves having facing ridges at the top surface of the bottom plates, and each of the two top plate grooves having open slots which fit around the ridges of the bottom plates to permit sliding between the plates but prevent the plates from separating vertically.

8. A method of connecting auto rack railroad cars together so that motor vehicles may be driven between them, comprising the steps of providing a telescoping bridge plate including a top plate with corrugations providing top surfaces separated by grooves, said top plate having an overlapping end portion and a locking end portion, a bottom plate with corrugations providing top surfaces which seat beneath the top surfaces of the top plate and grooves which seat beneath the grooves of the top plate, said bottom plate having an overlapping end portion and a locking end portion, said top plate overlapping end portion and said bottom plate overlapping end portion being in sliding engagement, means holding top and bottom plates together and preventing them from separating vertically, and bridge plate connecting means mounted on the locking ends of the top and bottom plates for connecting the bridge plate to adjacent auto rack railroad cars so that the bridge plate extends between the adjacent auto rack railroad cars and motor vehicles may be driven from one railroad car to another over the bridge plate, said bridge plate connecting means including spring loaded locking pins mounted on the locking ends of the plates for fitting into pieces of pipe mounted on the ends of the railroad cars, said locking pins being connected together by a return spring which urges the pins outwardly to a lock position, operating handles mounted on the locking pins for moving the locking pins from locked to retracted position, landing feet mounted on the bridge plate connecting means for protecting the operating handles from breakage, and a lock body which houses the locking pins and return spring, grasping the operating handles and retracting the locking pins of one of the top and bottom plates, placing the retracted locking pins in alignment with pipes mounted on an auto rack railroad cars, inserting the pins into the pipes mounted on the auto rack railroad car to connect the bridge plate to the auto rack railroad car, extending the other plate toward an adjacent auto rack railroad car, grasping the operating handles and retracting the locking pins of the other of the top and bottom plates, placing the retracted locking pins in alignment with pipes mounted on the adjacent auto rack railroad car, and inserting the pins into the pipes mounted on the adjacent auto rack railroad car to connect the bridge plate to the adjacent auto rack railroad car.

* * * * *